United States Patent [19]

Wain

[11] 4,146,778

[45] Mar. 27, 1979

[54] RECORDING ELECTRICAL INFORMATION

[75] Inventor: John L. Wain, Cheadle Hulme, England

[73] Assignee: Barcrest Limited, Lancashire, England

[21] Appl. No.: 756,271

[22] Filed: Jan. 3, 1977

[30] Foreign Application Priority Data

Jan. 9, 1976 [GB] United Kingdom ..... 00750/76

[51] Int. Cl.[2] ..... G06M 3/12; G07D 9/00

[52] U.S. Cl. ..... 235/92 AC; 133/8 R; 194/1 N; 235/92 CN; 235/92 CT; 235/92 R; 235/92 T; 235/92 PL

[58] Field of Search ..... 235/92 CN, 92 GA, 92 T, 235/92 CT, 92 AC, 92 PL, 92 PD, 92 DE; 133/8 R; 194/DIG. 3, DIG. 11, 1 M, 1 N

[56] References Cited

U.S. PATENT DOCUMENTS

| | | | |
|---|---|---|---|
| 3,120,602 | 2/1964 | Lagarde | 235/92 CT |
| 3,436,530 | 4/1969 | Faude et al. | 235/92 CT |
| 3,551,652 | 12/1970 | Faude | 235/92 CT |
| 3,754,122 | 8/1973 | Dinapoli et al. | 235/92 DN |
| 3,779,357 | 12/1973 | Haller et al. | 235/92 CT |
| 3,878,371 | 4/1975 | Burke | 235/92 PD |
| 3,934,123 | 1/1976 | Maurer | 235/92 EA |
| 3,959,632 | 5/1976 | Trehn et al. | 235/92 AC |
| 4,038,525 | 7/1977 | Freeman | 235/92 CN |

*Primary Examiner*—Joseph M. Thesz

*Attorney, Agent, or Firm*—Shoemaker and Mattare, Ltd.

[57] ABSTRACT

Information concerning operation of a money or token taking machine is recorded with an electrical recording module which can subsequently be detached from the machine and read with a separate electrical reading device. A latching system is disclosed and may be used to prevent re-insertion of the module into the machine before it has been read. A plurality of interchangeable modules can be used with different machines and a common reading device, and the modules may record unique machine codes and also provide unique module codes in addition to recording machine operation data. The reading device can also read without erasing. An eraser is also disclosed for erasing recorded information after reading with the reading device, a protective system is also disclosed for preventing presentation of a module to the machine, reading device, eraser system out of a predetermined sequence. A module can be capable of retaining recorded machine data, machine code and module code even when not externally powered.

46 Claims, 11 Drawing Figures

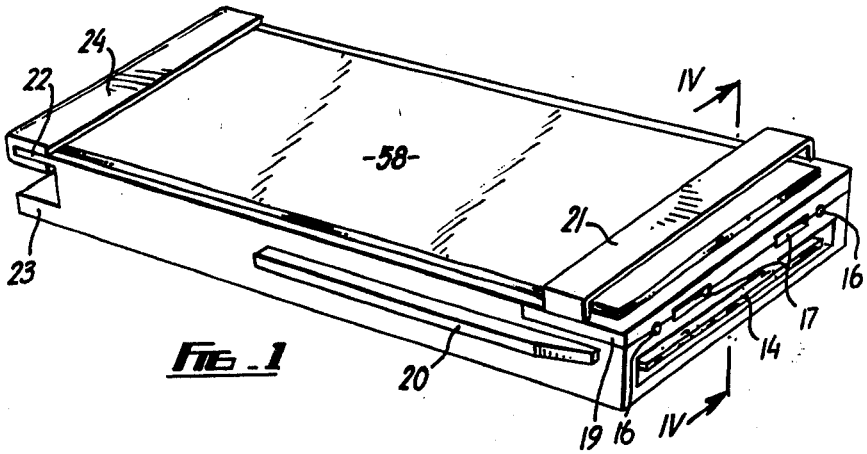
FIG. 1
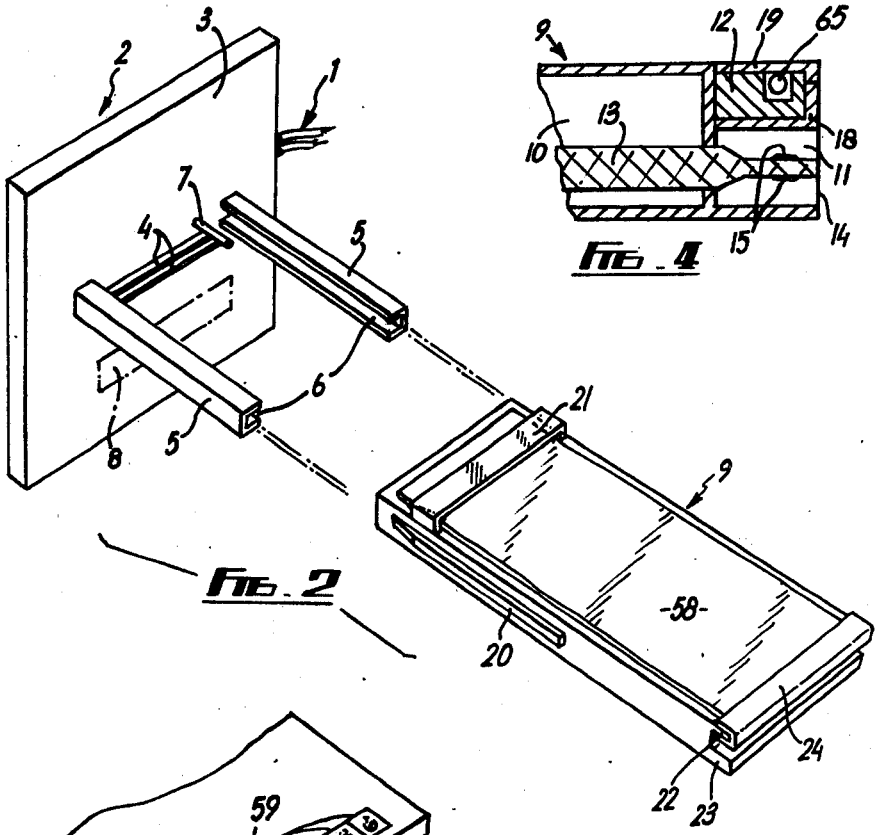
FIG. 2
FIG. 4
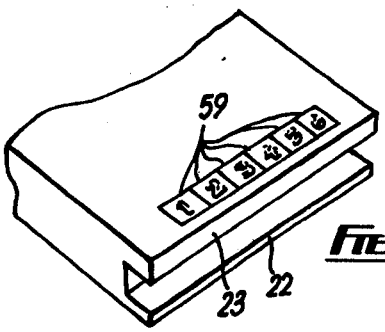
FIG. 3

RECORDING ELECTRICAL INFORMATION

This invention relates to the recording of electrical information in the context of machines of the kind, hereinafter referred to as being of the kind described, which in use are intended to be operated in correspondence with a transaction involving money or valuable tokens. The invention is primarily concerned with a machine of the kind described which is adapted to receive money or tokens and to perform operations related to such received money or tokens, particularly an amusement or gaming machine which is actuated by feed of coins therein and can then be operated to provide amusement and/or the possibility of winning coins or tokens, but it is not intended that the invention should be restricted to such machines and the invention may also find application in the field of vending machines, change-giving machines, tills, petrol pumps and the like.

With a gaming machine of the "fruit machine" kind, that is, a machine which is actuated by insertion of coins or tokens into the machine and can then be operated to produce in a random manner a display of symbols behind a number of windows, it is usual to provide meters or counters within the machine which record information such as number of coins or tokens inserted, number of coins or tokens paid out, number of games played, and possibly also other information. Information of this kind is required so that, for example, the frequency of use and performance of the machine can be checked and to provide a safeguard against unauthorised removal of coins or tokens from the machine. The meters or counters are normally operated by electrical impulses generated on actuation and operation of the machine and may display counter impulses in digital form.

With this known arrangement coins or tokens are periodically emptied from the machine and the meters or counters are read. However, two main problems arise: firstly it is possible for the meters or counters to be deliberately or accidentally misread; and secondly there is the possibility of tampering with the operation of the meters or counters so that coins or tokens can be stolen without this being apparent from the information displayed on the meters or counters.

In practice these are serious problems and an appreciable amount of money is lost due to human error or dishonesty.

One object of the present invention is to provide a monitoring system which can be used to overcome or at least minimise these problems.

According to one aspect of the present invention therefore there is provided a monitoring system for a machine of the kind described, said system comprising an electrical recording device mounted on the machine so as to record information determined by operation of the machine and an electrical reading device separate to said machine but being detachably connectable to said recording device for electrically reading said information and providing an intrepretable output indicative thereof.

With this arrangement, use of the machine can be monitored by means of the recording device and when information is required concerning such use this can be obtained by reading the recorded information electrically with the reading device. It will therefore be appreciated that errors arising from human misinterpretation can be largely or wholly avoided. Further, having regard to the possible complexity of the system and having regard to the fact that it is possible to arrange for access thereto to be restricted and for appropriate safeguards to be incorporated therein as disclosed hereinafter, it is thereby possible to ensure that undetected tampering can also be largely or wholly avoided.

In a preferred embodiment of the invention, the recording device is detachable from the machine and may be taken to a fixed remote reading system and/or to a portable reading device used in the vicinity of the machine. Alternatively, however, if desired the recording device may permanently be fixed to the machine and a portable reading device may be brought to the machine for reading purposes.

Information read by the reading device may be displayed or read out in any suitable manner via means incorporated in or connected to the recording device. Alternatively or additionally processing means may be provided for processing information read by the reading device. Such processing means may be arranged at a location remote from the reading device and connected thereto via an appropriate link such as a telephone cable link.

The recording device where this is detachable from the machine, or the reading device where the recording device is not detachable, may be provided with a sheet or sheets for detachable mounting thereon to receive written and/or impressed markings thereon. In this, as a further or supplementary check on the information recorded by the recording device, information can also be read and recorded by a person.

Whilst the recording device may take any suitable form, preferably, electronic circuitry is employed and integrated circuitry, particularly of the CMOS kind as especially advantageous due to its low power consumption.

Such circuitry may incorporate one or more devices operable to record information in the form of electrical impulses. Electronic counters which count impulses in binary form are particularly suitable. There may be any suitable number of counters (say up to 8 or 10) and the number may be in excess of the number of items of information to be recorded from a particular machine whereby the recording device can be used with other machines having available more items of information when desired.

The circuitry of the recording device may also be adapted for purposes other than the counting of machine impulses. Thus, for example, it may record the time during which the recording device is operational for recording said machine impulses, and it may record information, received from the machine, relating to the type of the machine and/or the siting of the machine or the like.

Provision may be made for allowing disablement of the machine impulse counting function, for example for test and maintenance purposes, and a timer may be provided for recording the duration of any such periods of disablement.

Most preferably the recording device is self powered and/or includes memory retaining recording elements so as not to be dependent for its operation on power received from the machine or other external source.

With regard to the reading device of the monitoring system, preferably this is arranged to read information recorded by the recording device without eradicating such information from the recording device. Thus, in the case where information is recorded in the recording device on electrical impulse counters each having a predetermining maximum count, reading of said counters may involve feeding into the counter a number of impulses equal to the maximum count of the counters, whereby the counter records the same count before and after recording of same.

Preferably, and in accordance with a second aspect of the present invention an electrical recording device for use in the monitoring system described above is in the form of a module comprising electronic circuitry enclosed within a casing, said circuitry including electrical recording means capable of recording information and of retaining recorded information even when the circuitry is not connected to a power source externally of the module, and input and output terminals for the circuitry accessible from the exterior of the casing, said casing being adapted for detachable cooperation with information producing and reading devices with said terminals detachably connected respectively to contacts of said information producing and receiving devices respectively for receiving information therefrom and feeding recorded information thereto.

This arrangement is particularly advantageous both from the security point of view in that the casing can be securely sealed against tampering and from the maintenance point of view in that faults can be readily rectified by replacement of the recording device.

As a means of identification of the module, of particular importance in the case where a plurality of like modules are used and a fresh module is used to replace a recorded module when the recorded module is removed for reading purposes, the circuitry of said module may incorporate means interconnecting terminals thereof in a predetermined pattern defining an electrical identifying code for the module.

Alternatively or additionally the casing of the module may have a coded identification marked thereon comprising for example raised characters formed on the casing.

For use in detachably mounting the module in the machine, the module may have guides at sides thereof, for example ribs, which engage cooperable guides, for example grooves, which may be provided on arms of a mounting device in the machine.

In order to prevent or at least limit the possibility of inserting the module out of sequence into the machine, the reading system and any eraser which may be provided for erasing recorded information, a mechanical latching system may be provided in the module for cooperation with latching elements on one or more of said machine, reading device and eraser. Said latching system may include at least one latching member within the casing which has first and second positions, said latching member being arranged to block first opening in the casing in the first position and to release said opening in the second position, said first opening being adapted to permit passage of a latching element therethrough only when the latching member is in the second position, and a second opening being provided in the casing for receiving a latching element therethrough for moving the latching member to its second position from its first position. A catch member may be associated with the latch member for holding said latch member releasably in each said position thereof and with this arrangement in a preferred embodiment the catch member covers said first opening when the latch member is in its second position and the catch member and the latch member as respectively visible through said first opening are differently coloured.

The invention will now be described further by way of example only and with reference to the accompanying drawings in which:

FIG. 1 is a top perspective view of one form of a module according to the present invention;

FIG. 2 is a perspective view of the module of FIG. 1 to a smaller scale shown detached from a mounting device for the module;

FIG. 3 is a bottom perspective view of a rear end of the module of FIG. 1 with a retaining clip thereof removed;

FIG. 4 is a sectional view on the line IV—IV of FIG. 1;

Figure 5:
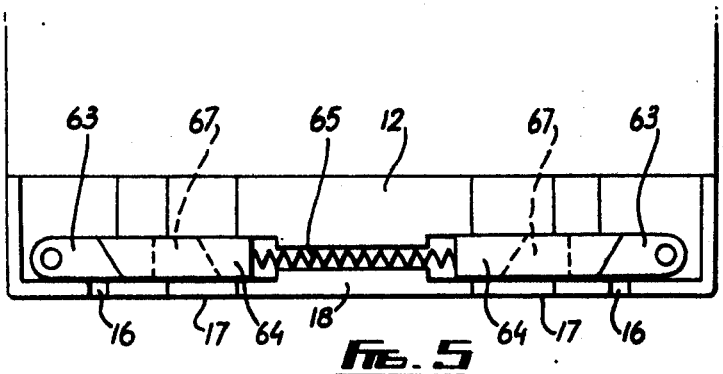
FIGS. 5 to 8 are diagrammatic views from the top of the front end of the module with a cover plate thereof removed, in different operational states of the module, FIGS. 6 and 8 showing operating prongs in engagement therewith.

The module and the monitoring system shown in the drawings are for use in conjunction with a gaming machine of the "fruit machine" kind which has three drums (not shown) which are marked with symbols on the radially outer peripheries and are rotatably mounted behind windows in a front panel of the machine. The machine is actuated by insertion of a coin (or token) through a slot into the coin chute of a coin operated actuating mechanism and the drums can then be set in rotation for example by operation of a switch or the like by the player. The drums rotate for different random periods of time and then come to rest with symbols displayed through the windows. A pay-out of coins (or tokens) can be obtained if a predermined winning combination of symbols is displayed.

On actuation and operation of the machine, electrical impulses are produced by appropriate electrical devices and these are applied to electromagnetic digital counters within the machine to provide a record of, for example, the number of games played, number of coins (or tokens) inserted, number of coins (or tokens) paid out, etc. There may be any number of these counters (up to say, eight) depending on the nature and construction of the particular machine.

The arrangement so far described is wholly conventional. However, contrary to conventional practice, the output leads running from the impulse-generating electrical devices to the counters have connection leads 1 connected in parallel with same (FIG. 2). The connection means 1 are connected in parallel with the output leads, using known connectors by breaking each output lead and inserting the two broken ends together with an end of the respective connection lead into the respective connector. A deformable portion of the connector is then pressed into engagement with the ends of the leads so as to link same together mechanically and electrically so that they cannot be separated without cutting the leads or destroying the connector. With this arrangement unauthorised disconnection of the leads can be prevented or at least hampered.

The connection leads 1 are connected to a mounting device 2. The mounting device 2 comprises a board 3 which is rigidly secured at an appropriate position within the fruit machine and which has, at a front surface thereof two spaced elongated banks 4 of electrical contacts to which the leads 1 are connected. At each end of the contact bands 4 there is a respective guide rail 5 which projects perpendicularly from the board 3. The two rails 5 have grooves 6 at their inner sides. Adjacent one rail 5 and above the contact banks 4 there is a projecting prong 7 in the form of a rod.

Below the contact banks 4 there are two parallel conductive strips 8 which are connected to two of the contacts of the banks 4. Other contacts of the banks 4 (say 12 contacts) are connected to one or the other of the strips 8 in a predetermined manner so that when two different potentials are applied to the two strips (as will be described in more detail hereinafter), a predetermined pattern of electrical potentials, or a "word" in binary form (of say 12 bits) is defined. This word is unique to the particular fruit machine and therefore represents a "machine code" capable of identifying the machine.

For connection to the mounting device 2 so far described there is provided a module 9 which is in the form of an enclosed elongated rectangular casing, say $9\frac{1}{4}'' \times 4\frac{1}{2}'' \times \frac{3}{4}''$. The module 9 as can be seen more clearly from FIG. 4, is a hollow box structure formed from plastics mouldings which in the finished module are permanently welded or bonded together so that access to the interior of the box structure can only be had by destroying the module, except for access obtained via openings at the front end of the module yet to be described.

The interior of the module 9 is divided by partitions into three main compartments 10, 11, 12.

In one compartment 10, which occupies a major portion of the module 9, there is a printed circuit board 13 carrying electronic components, and batteries (not shown).

A further one of the compartments 11 extends across the width of a front end of the module and is open at the front end edge 14. The printed circuit board 13 projects through into this compartment 11 and terminates within the compartment 11 in upper and lower rows of electrical terminals 15 which are connected to the circuit on the board 13.

The third compartment 12 is arranged above the second mentioned compartment 11 at the front end of the module 9 and contains a mechanical latching system described in more detail hereinafter. There are four holes 16, 17 in a front end wall 18 of the module 9 provide access to the compartment 12, such holes 16, 17 comprising a circular hole 16 and an elongated hole 17 at each side of the front end edge of the module 9. The third compartment 12 has a closure plate 19 forming a top wall and part of the front wall of same, such plate 19 being bonded securely in position.

Along the two long side edges of the module 9, there are projecting ribs 20 which extend from positions adjacent the front end of the module 9 to about mid way along the length of the module. The module 9 can be detachably engaged with the mounting device 2 by sliding the module 9, front end first, between the rails 5 with the ribs 20 engaged with the grooves 6, until the contact banks 4 pass through the open front end 14 of the lower front compartment 11 of the module 9 and fit respectively above and below the rows of terminals 15 and in secure electrical contact therewith. In this position the prong 7 engages the respective one of the holes 16. In order to hold the module 9 tightly but releasably in position, spring loaded balls (not shown) or the like may be provided within the grooves 6.

On the top of the module 9 adjacent the front end there is a transparent strip 21 of plastics material slightly spaced above the module top surface. At the rear end of the module there are upper and lower projecting lips 22, 23 defining a channel therebetween. The upper lip 22 is thinner than the lower lip 23 and a chip 24 in the form of a springy strip of U-shaped cross-section detachably grips the upper lip 22. The function of these parts will be described later.

Figure 11:
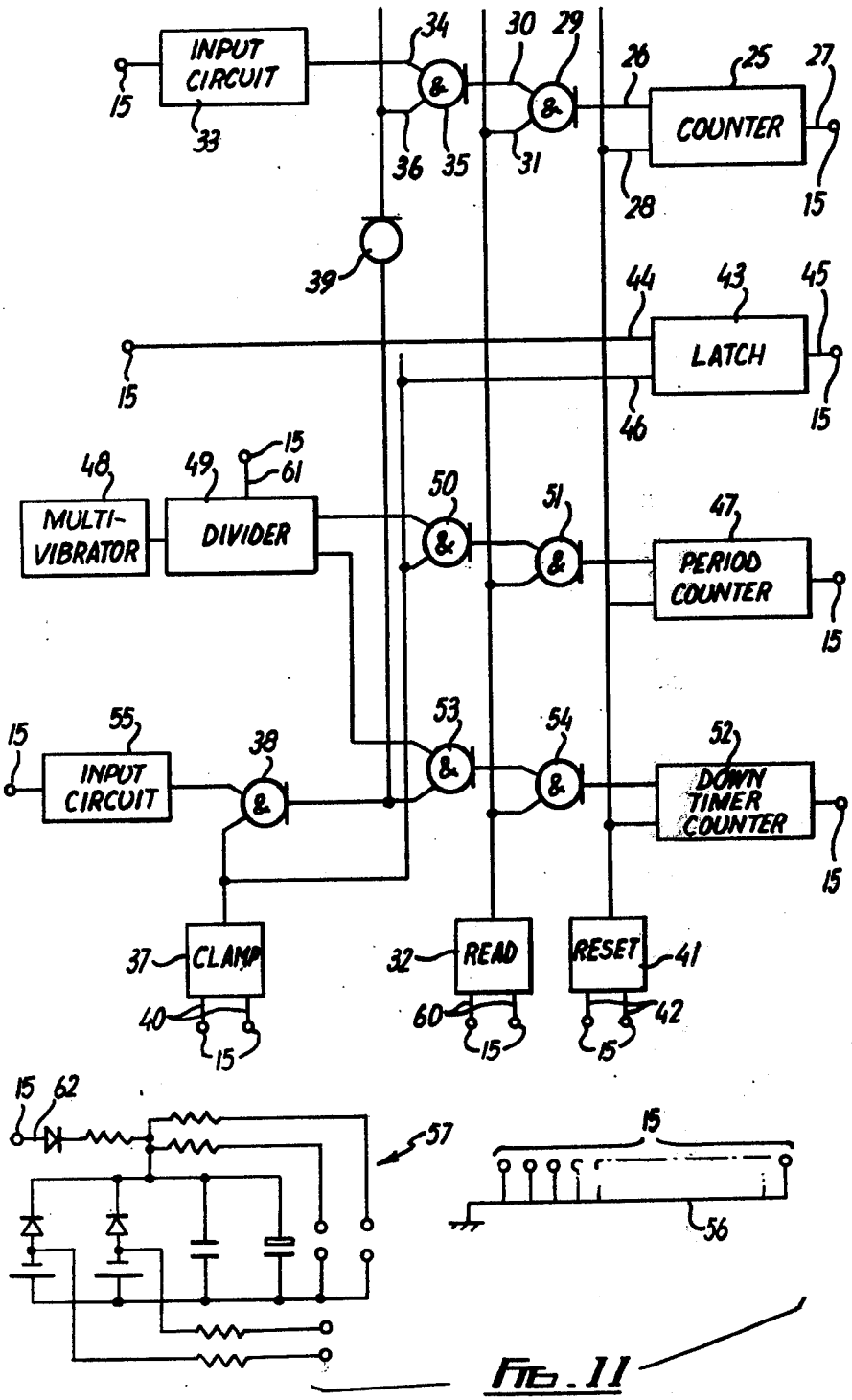
FIG. 11 is a circuit diagram of the module.

As shown in FIG. 11, the circuitry on the printed circuit board 13 within the casing of the module 9 includes an arrangement of say eight CMOS integrated circuit devices 25 (one for each electromagnetic machine counter) which are counting circuits each with a capacity of $2^{14}$ counts. Each counting circuit 25 has a counting input 26, an output 27 at which an output signal is obtained when the counting capacity of the circuit has been reached, and a re-set input 28. For the sake of simplicity only one device 25 is shown in the drawing.

The input 26 of each device 25 is connected to the output of a first respective NAND gate 29 and two inputs 30, 31 of the NAND gate 29 are connected respectively to a common "read" circuit 32 which will be described in more detail hereinafter, and a respective input circuit 33. The input circuit 33 is connected to a respective terminal 15 of the module 9 which in use is connected to one of the leads 1 connected to one of the electromagnetic counters when the module is engaged with the monitoring device 2 as described above. The input circuit 33 incorporates a noise filter, a pulse shaper and also protective components whereby any voltage customarily encountered in gaming machines (say, in the range 6v to 240v) can be safely handled, and the input circuit 33 is connected to one input 34 of a NAND gate 35 the output of such gate 35 being connected to the input 30 of the NAND gate 29. The other input 36 of the NAND gate 34 is connected to a clamp circuit 37, which is common for all devices 25 via a NAND gate 38 and an inverter 39. The clamp circuit 37 comprises a NOR gate having two inputs 40 connected to two terminals 15 of the module 9.

The output 27 of each counting device 25 is connected to a respective terminal 15 of the module 10 and the re-set input 28 is connected to a reset circuit 41 comprising a NOR gate having two inputs 42 connected to two module terminals 15. The device 25 can only be re-set by connecting both inputs 42 simultaneously to earth potential.

The module 9 also incorporates 12 latch circuits 43, only one of which is shown, which have inputs 44 which are connected to terminals 15 of the module which, when the module is plugged in the device 2, are connected to the respective "bits" of the "word" defined by the connections to the conductive stips 8. Each latch circuit 43 has an output 45 connected to a module terminal 15, and a control input 46 which is connected directly to the common clamp circuit 37.

The module 9 further incorporates a period timing circuit comprising a high frequency pulse generator 48 connected to a divider 49 to reduce the pulse frequency. The divider output is arranged to drive a counting device 47, of the same kind as the devices 25, via two NAND gates 50, 51. The two NAND gates 50, 51 are connected in like manner to the gates 29, 35 to each other and to the comon read circuit 32 and directly to the common clamp circuit 37. The device 47 has a reset input connected to the common reset circuit 41.

The divider 49 is also arranged to drive a down timer counter 54 via two NAND gates 53, 54 which are connected to each other and to the common read circuit 32 and to the common clamp circuit 37 via the NAND gate 38. The counter 52 is of a similar kind to the counter 25 and has a reset input which is connected to the common reset circuit 41.

The NAND gate 38 has one input connected to the clamp circuit 37 and the other input connected to a module terminal 15 via an input circuit 55. Such terminal is, when the module 9 is engaged with the mounting device 2, connected to a door switch on a rear door of the fruit machine. The arrangement is such that the counters 25 are disabled whenever an input is applied to the input circuit 55 corresponding to opening of said rear door and at the same time the counter 52, since it is connected to the clamp circuit 37 via the NAND gate 38 but not the inverter 39, is set in operation.

As a means of electrical identification of the module 9, a number of the module terminals 15 are selectively connected to a common potential base line 56 to define a binary word, which is unique to the module 9, of say 18 bits.

As already mentioned, the module 9 is powered by two batteries or cells, which may be of a rechargeable nature, and these are connected in a supply circuit 57 which provides a stable supply, even in the case where one of the batteries fails, for powering the module circuitry.

Figure 9:
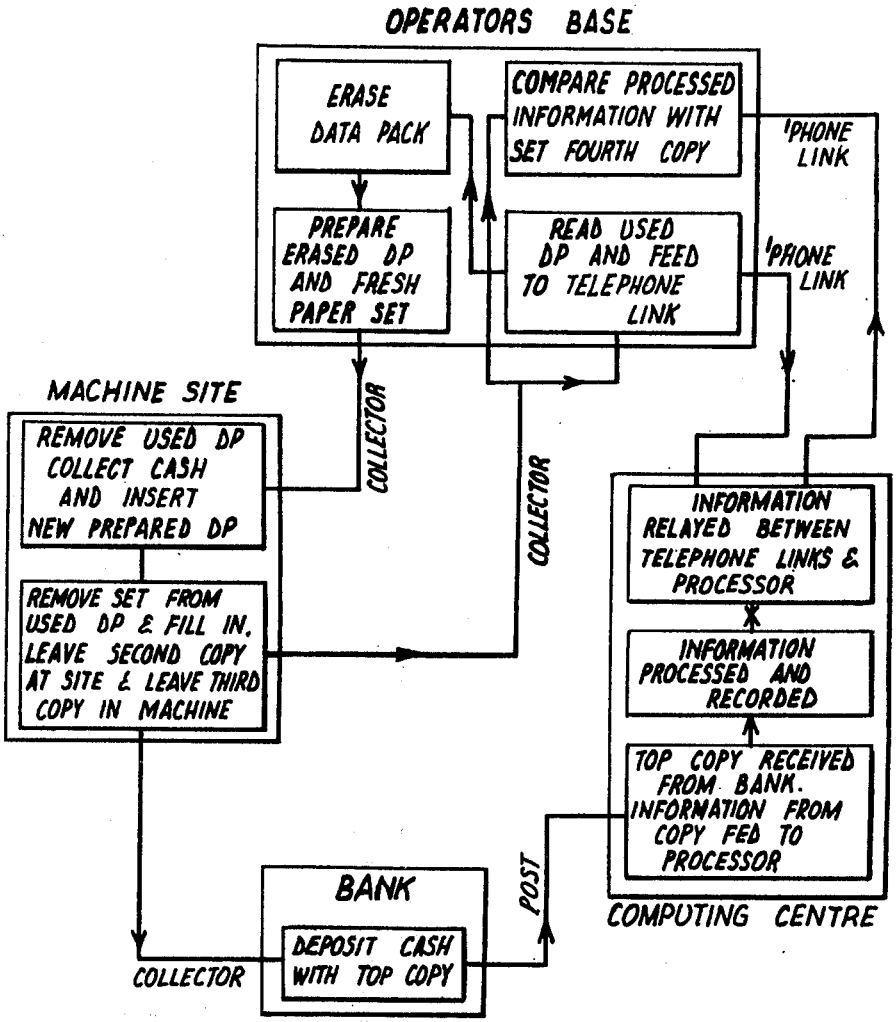
FIGS. 9 is a flow chart illustrating operation of one form of a monitoring system according to the invention employing the module of FIGS. 1 to 8.

The mode of operation of a monitoring system for the fruit machine, using the module 9 so far described, will now be described with particular reference to FIG. 9.

The fruit machine is installed at a particular site at which it is to be used. At an Operators Base, the module 9 so far described, is prepared for insertion into the machine. In this state, the counters 25, 47, 52 are set to zero. A set 58 (FIGS. 1 and 2) of attached record sheets, each sheet being of dimensions slightly less than the dimensions of the top surface of the module 9, is selected for use with the module. The sheets of the set have top faces marked with spaces for the entry of written information and the sheets are detachably fixed together at one end. Carbon paper or other similar medium is provided on or between the sheets so that information written on the top sheet can be transferred to the copy sheets beneath.

There is also a space on the sheets on which information can be impressed. The sheets are inserted into an impressing device (not shown) which presses said spaces on the sheets into contact with a selected plastics card with raised information thereon and into contact with the under surface of the module adjacent the thicker lip 23 of same. The plastics card bears, in raised figures, information which identifies the machine site. The under-surface of the module 9 in the vicinity of the lip 23, as can be seen in FIG. 3 bears raised figures which identify the module and which correspond to the module electronic identification card. The figures on the module 9 are formed by bonding blocks 59 moulded with the figures into a moulded channel in the module. The thick lip 23 ensures a rigid support for the raised figures on the module during the impressing process.

The set 58 of sheets is then fixed to the top surface of the module by inserting the end at which the sheets are connected together beneath the clip 24 and by inserting the opposite end beneath the strip 21.

The module 9 and attached set 58 is then taken by hand by a collector to the Machine Site. Assuming that the machine has been in use there will already be a module like the module so far described, in engagement with the mounting device and having its respective set 58 with impressed module and site information clipped to the top surface thereof. This latter module contains information which has been electrically recorded from the fruit machine in a manner yet to be described. The recorded module is disengaged from the machine and replaced with the fresh module. Coins are removed from the machine and are counted. The total is written on the set 58 of the recorded module 9 together with other information and the top sheet of the set and the money are taken by the collector to a Bank.

A second copy from the set 58 is handed to a site representative, a third copy is stored in the machine, and a fourth copy is taken, with the recorded module 9 back to the Operators Base.

At the Operators Base, the recorded module 9 is plugged into a mounting device, of similar form to the device 2, in a Reader. The Reader reads the information stored in the module 9 electrically without erasing such information in a manner yet to be described, obtains further information from the module for example as to battery conditions, and converts all such information into a form suitable for transmission along a telephone link to a computer at a Computing Centre. At such Centre the information is processed and recorded together with information fed into the computer taken from the top sheet of the set 58 when such top sheet has been received by post from the Bank. Processed information is fed back to the Operators Base, immediately after transmission of information from the Base to the centre, for comparison with the fourth copy of the set 5. Interpretative information is also available subsequently from the Computing Centre after the top sheet of the set 58 has been received.

Assuming that the information fed back from the Computing Centre does not indicate a fault condition or other unusual state of the module, the module is then removed from the reader and plugged into a mounting device, similar to the device 2, of an eraser. In the eraser, in a manner yet to be described, the counting devices 25, 47, 52 are set to zero and the module is then available for re-use.

The recording process when the module is inserted in the fruit machine takes place as follows:

When the terminals 15 on the module 9 are brought into engagement with the contacts 4 on the mounting device 2, the two inputs 40 of the NOR gate of the clamp circuit 37 are changed from positive power supply potential to earth potential and the output of the clamp circuit 37 changes from 0 to 1. This output is applied to the latch circuits 43 to actuate same and is also applied to one input of the NAND gate 38.

If the door switch connected to the input circuit 55 is in a state corresponding to a closed position of the door, an output signal value 1 is applied to the other input of the NAND gate 38 and via the inverter 39 an output signal value 1 is applied to one input of the NAND gates 35.

The pulse generator 48 which is a multi-vibrator produces, via the divider 49, a pulse chain which, with the circuit in the state so far described, is fed via the NAND gates 50, 51 to the counter 47 which counts the pulses and thereby effectively records the passage of time.

The latch circuits 43 operate in response to signals (1 or 0) applied thereto derived from potentials applied to the appropriate conductors 8 by the power supply in the module 9, and the circuits 43 latch to provide a record of the nature of the signals and hence a record of the machine identification word.

Electrical impulses applied to the input circuits 33 in response to actuation and operation of the machine cause shaped pulses to be fed via the NAND gates 35, 29 to the respective counting devices 25 whereby the numbers of the impulses are recorded and thereby information related to, for example, amount of money or tokens fed into the machine, amount and frequency of pay out, and the like, is recorded.

In the event that there is believed to be a fault in the machine, the machine rear door may be opened and money or tokens may be inserted into the machine for test purposes, such money or tokens subsequently being removed from the machine cash box.

In this case, the test operation is not recorded due to the fact that the rear door switch modifies the output of the input circuit 55 to the NAND gate 38 so that the signal applied to the NAND gates 35 from the inverter 39 changes to 0. In this situation, since the NAND gate 38 is connected directly to the NAND gate 53, and not via the inverter 39, impulses from the divider 49 now actuate the counter 52 whereby a record is obtained of the total time during which the rear door is open.

When the module 9 is removed by the collector to be replaced with a fresh module, the state of the clamp circuit 37 changes whereby the counters 25, 47, 52 and latch circuits 43 are all rendered incapable of further operation.

The information contained in the module is then read at the Operators Base as follows:

In order to determine the count of each device 25 without cancelling the information contained therein, a number of pulses from a high frequency pulse generator (not shown) are fed into each counter 25 so as to advance same through one complete cycle (in this case $2^{14} = 16384$ pulses). The pulses are fed through the read circuit 32 after first connecting input pins 60 of same to earth in order to actuate the circuit. At the same time, an up/down counter (not shown) of equal capacity to the device 25 ($2^{14}$ counts) is counted down from a preset count of 16384 by the pulses fed to the device 25. The output 27 of the device 25 is connected to a latch circuit for the up/down counter whereby, when the device 25 reaches its maximum count, the up/down counter is prevented from counting down further. The device 25 continues on its counting cycle until it reaches the same count as was originally recorded, and the up/down counter is fixed at the same count. The up/-down counter can then be used to operate any suitable visual display, print out device or the like and supplies information for feeding to the computer.

Alternatively, instead of transferring the recorded count of each device 25 to an up/down counter, the count may be transferred to an up counter. In this case, $2^{14}$ pulses are fed to the device 25 and simultaneously to the up counter but the up counter is prevented from starting to count until the device 25 reaches its maximum count.

The other counters 47, 52 can be read in like manner to the counters.

The latch devices 43 are read in conventional manner and a record is obtained for their different states, representative of the bits of the machine identifying word. Similarly a record is obtained of the bits of the module identification word from the terminals 15 associated with the base line 56.

The use of the multi-vibrator/divider combination 48, 49 to produce timing pulses enables accurate timing to be achieved, but there is no need for the divided output frequency to be set at any special value. Instead, the Reader monitors the actual frequency via a module terminal connected to a monitor output 61 of the divider 49.

For the sake of convenience, when the module 9 is inserted into the Reader, the power supply voltage of the module 9 is "jacked-up" via a module terminal connected to an input 62 of the circuit 57 so as to be the same as the Reader operating voltage.

After the module 9 has been read it is removed from the Reader and subsequently inserted into the Eraser where the counters 25, 47, 52 are all re-set by application of appropriate potentials to both inputs 42 of the reset circuit 41.

As will be appreciated from the foregoing, it is desired that the module 9 should be inserted into the machine, the Reader and the Eraser in a set sequence and should not, for example, be deliberately or inadvertently inserted into the Eraser after removal from the machine before it has been inserted into the Reader. With a view to preventing this out of sequence insertion, the module contains a mechanical latching system, as shown in detail in FIGS. 5 to 8.

The latching system is located in the upper front compartment 12 of the module 9 and comprises, at each side, a respective pivotally mounted member 63 and a further member 64 slidably mounted in a channel. Coiled hair springs are provided around the pivot joints of the members 63 which act to urge the members 63 towards the front of the module, as shown in FIG. 5. A helical coil spring 65 is provided in a narrow passage between the two channels for the members 64 and such spring 65 projects at each end into blind bores in the members 54 so as to urge such members 64 away from each other.

The members 63, 64 have inclined end faces and in one state of the latching systems, as shown in FIG. 5, the members 63, 64 at each side are aligned and are held firmly in position, by the action of the springs, with the inclined faces in contact with each other.

The two members 64 are formed from black plastics material and the two members 63 are formed respectively from green plastics and red plastics material. In the position of FIG. 5, the green and red plastics material can be seen respectively through the left and right holes 16 thereby giving a visual indication externally of the module of the state of the latching system.

Figure 6:
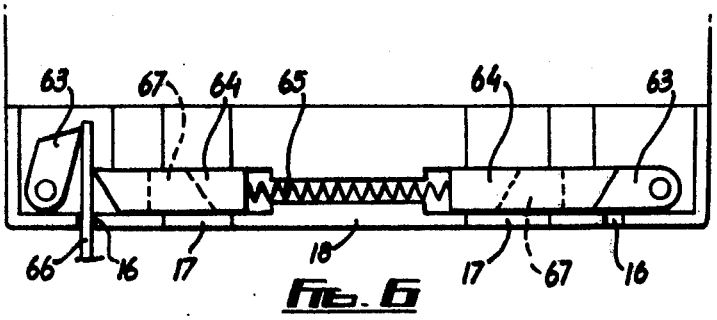
Figure 7:
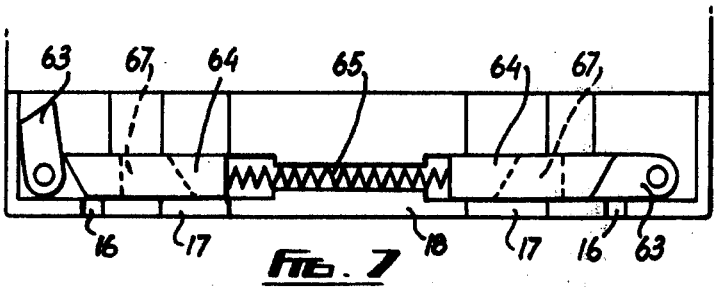

The state of the latching system can be changed from that shown in FIG. 5 by inserting a rod shaped prong 66 through one hole 16 (the left hole as shown in FIG. 6) whereupon the left member 64 is moved slightly to the right and the member 63 is pivoted to the rear of the compartment 12. On removal of the prong 66 the member 64 moves to the left and is pressed against the side of the member 63 so as to hold the member 63 in its pivoted position (FIG. 7). The black plastics of the member 64 is now visible through the hole 16 instead of the green plastics of the left member 63.

Figure 8:
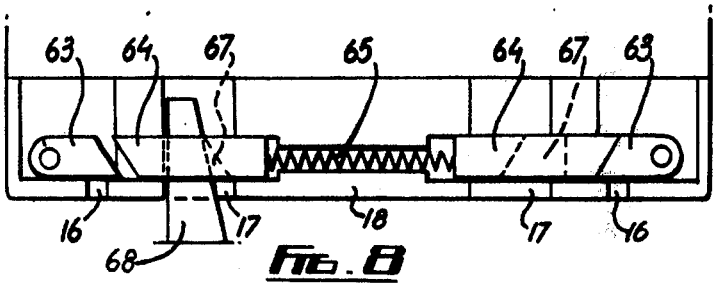

Each member 64 has a tapered slot 67 therethrough and in the arrangement of FIG. 7 this is partially exposed through the respective slot 17 in the front wall 18 of the compartment 12. As shown in FIG. 8, a tapered prong 68 can be inserted through the slot 17 into the slot 67 so as to cause the member 64 to be moved to the right away from the member 63 to the extent that the member 63 can pivot back towards the front of the compartment 12. On withdrawal of the tapered prong 68 the system returns to the state shown in FIG. 5.

Figure 10:
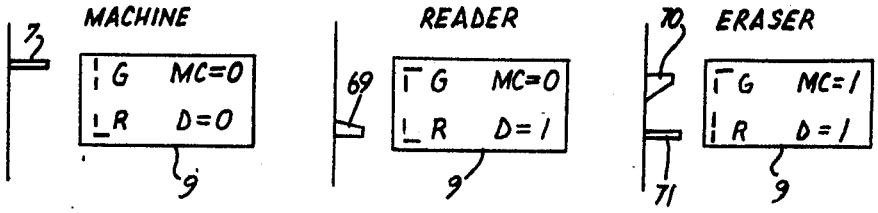
FIG. 10 shows diagramatically different operational states of the module at different stages of the monitoring system.

Referring now to FIG. 10 there is shown diagrammatically the state of the latching system as the module 9 is presented to the mounting devices of the fruit machine, the Reader and the Eraser.

Thus, as already described, the machine mounting device has a rod like prong 7, and the module 9 is presented to the machine with the right member 63 pivoted to the rear but not the left member 63. The prong 7 causes the left member 63 to be pivoted to the rear and thus the module 9 is presented to the Reader with both members 63 pivoted to the rear. At the Reader there is a tapered prong 69 at the right which acts to return the right member 63 to its front position and the module 9 is therefore presented to the Eraser with only the left member 63 pivoted to the rear. At the Eraser there is a tapered prong 70 at the left and a rod prong 71 at the right which act to return the members 63 to the positions at which the module is ready for insertion into the machine.

At each state of the latching system there will be a different combination of colours visible through the holes 16. If, despite the indication given by the colour combination, the module is presented out of sequence, to either the machine or the eraser it will be seen that it will not be possible to insert the module because the respective hole 16 corresponding to the respective rod like prong 70, 71 will be blocked due to the presence of the respective member 64 across such hole 16 instead of the respective member 63. It will be noted that the module 9 can be presented out of sequence to the Reader but this need not cause any harm or inconvenience. However, should the arrangement be such that it is harmful or inconvenient for the module to be represented to the Reader immediately after having been read and before being erased, an electronic safeguard may be provided, namely, when the module is first inserted into the Reader to be read, an electronic latch is set after the module has been successfully read. The module cannot be re-read whilst this latch is set and the latch remains set until the module has been inserted into the Eraser.

The above described monitoring system can be applied to an existing fruit machine in a simple and convenient manner and provides a remarkably reliable and tamper proof system for checking on the operation of such machine. In particular, in this respect, the sealed, self-contained, self powered module, and the various mechanical and electronic safeguards against mis-use and tampering as described above, are particularly advantageous features.

It is of course to be understood that the invention is not intended to be restricted to the details of the above embodiment which are described by way of example only.

Thus for example, the module may take any suitable form and may be capable of recording any suitable information additional to or instead of the above mentioned information.

Whilst it is preferred that the module should be a self powered device, this is not essential and the device may be powered from the machine in which case it will incorporate electrical recording devices, most preferably devices which record in binary form, which retain recorded information, even when not powered, until they have been deliberately cleared.

The module may also incorporate processing circuitry whereby recorded information can also be at least partially processed.

Reading of the information in the module, additionally or alternatively to the aforementioned reading at the Operators Base, can be effected on site, for example using a portable reader or reader/processor. Conveniently, such a reader or reader/processor may have a keyboard control to enable selected information to be displayed and/or processed. In this case, the module may be detachable from the machine as described or alternatively may be permanently connected to same.

In addition, whilst specific reference has been made to fruit machines, the invention may also be applied to other machines and devices. Further, in the case where the invention is applied to a fruit machine, such machine need not be of the kind described above which has rotatable drums but may be of the kind having other rotatable members or even of the kind having a form of random selection not utilising rotatable members.

What I claim is:

1. A monitoring system, for a machine of the kind intended to be operated in correspondence with a transaction involving money or valuable tokens, said system comprising an electrical recording device detachably mounted on the machine so as to record information determined by operation of the machine, an electrical reading device separate to said machine but being detachably connectable to said recording device for electrically reading said information and providing an interpretable output indicative thereof and latching means on the machine and on the recording device for preventing reinsertion of the recording device in the machine before reading thereof after removal of the recording device from the machine.

2. A system according to claim 1, further including processing means for processing information read by the reading system, said processing means being arranged at a location remote from the reading device and being connected thereto via a cable link for receiving information to be processed.

3. A system according to claim 1, wherein the reading device is arranged to read information recorded by the recording device without eradicating such information from the recording device.

4. A system according to claim 3, wherein information is recorded in the recording device on electrical impulse counters each having a predetermined maximum count and reading of each said counter involves feeding into the counter a number of impulses equal to the maximum count of the counter, whereby the counter records the same count before and after reading of same.

5. A system according to claim 1, wherein an erasing device is provided for erasing recorded information from the recording device after reading of same and the reading device and erasing device also include latch devices which are co-operable with the latching system whereby the recording device cannot be erased until it has been read nor can it be reinserted in the machine until it has been erased.

6. An electrical recording device for use in the system of claim 1, in the form of a module comprising electronic circuitry enclosed within a casing, said circuitry including electrical recording means capable of recording information and of retaining recorded information even when the circuitry is not connected to a power source externally of the module, and input and output terminals for the circuitry accessible from the exterior of the casing, said casing being adapted for detachable co-operation with information producing and reading devices with said terminals detachably connected respectively to contacts of said information producing and receiving devices respectively for receiving information therefrom and feeding recorded information thereto.

7. A device according to claim 6, wherein the electrical recording means is arranged to record binary information.

8. A device according to claim 7, wherein the recording means comprises one or more electrical impulse counters.

9. A device according to claim 6, wherein the circuitry further includes a time recorder adapted to record passage of time.

10. A device according to claim 6, wherein the time recorder comprises an impulse generator connected to an impulse counter.

11. A device according to claim 6, wherein the circuitry further includes a plurality of electronic latches adapted to latch in different states on feed of appropriate inputs thereto and therefore give a record of such input.

12. A device according to claim 6, wherein the circuitry further includes means interconnecting a number of said terminals in a predetermined pattern defining an electrical identifying code for the module.

13. A device according to claim 6, wherein the circuitry further includes a disabling circuit connected to one of said terminals and to the recording means so as to disable said recording means when an actuating signal is present at said one terminal and timing means for recording the duration of disablement of the recording means.

14. A device according to claim 13, wherein the timing means comprises an impulse generator connected to an impulse counter.

15. A device according to claim 6, wherein the casing has a flat surface adapted to receive sheets thereon and attachment means is provided for detachably holding such sheets on said surface.

16. A device according to claim 6, wherein the casing has a coded identification marked thereon in the form of raised characters.

17. A device according to claim 6, wherein said casing has guides at sides thereof for detachable engagement with co-operable guides on said information producing and reading devices.

18. A device according to claim 6, including a mechanical latching system for co-operation with latching elements on one or more of the machines, the reading system and any eraser with which the module is to be used.

19. A device according to claim 18, wherein said latching system includes at least one latching member within the casing which has first and second positions, said latching member being arranged to block first opening in the casing in the first position and to release said opening in the second position, said first opening being adapted to permit passage of a latching element therethrough only when the latching member is in the second position, and a second opening being provided in the casing for receiving a latching element therethrough for moving the latching member to its second position from its first position.

20. A device according to claim 19 wherein a catch member is associated with the latch member for holding said latch member releasably in each said position thereof.

21. A device according to claim 20, wherein the catch member covers said first opening when the latch member is in its second position and the catch member and the latch member as respectively visible through said first opening are differently coloured.

22. A monitoring system for monitoring the operation of a plurality of machines of the kind intended to be operated in correspondence with a transaction involving money or valuable tokens comprising:

a plurality of machines each having an electrical machine connection means and means for producing electrical operating signals at said connection means in correspondence with operation of the machine, each said machine further including a code generating means connected to the machine connection means for producing at said machine connection means an electrical code signal unique to the respective machine;

a plurality of electrical recording modules, each module comprising electrical recording means and electrical module connection means, said recording means being connected to said module connection means for recording electrical signals applied to said module connection means, each said module further including a code generating means connected to the module connection means for producing at said module connection means an electrical code signal unique to the respective module;

said machine connection means of each machine being similar to the machine connection means of other machines, said module connection means of each module being similar to the module connection means of other modules and cooperable with said machine connection means so that any one module can be detachably mounted in any one machine with the connection means of the module and the machine detachably interengaged so that electrical operating and code signals produced by the machine can be recorded by said recording means of the module; and a common electrical reading device, said common electrical reading device being separate from said machines and from said modules, said reading device having an electrical reading means, and electrical reading connection means connected to said reading means, the module connection means of each of said modules being individually detachably interengageable with said reading connection means so that said reading means can read the module electrical code signal and also said electrical operating and machine code signals recorded by the recording means of the module.

23. A system according to claim 22, wherein the reading device includes means for reading signals recorded by the said recording means of each module with said information being preserved in said recording means.

24. A system according to claim 23, wherein said recording means of each module includes electrical impulse counters for recording signals, each impulse counter having a predetermined maximum count, and means for feeding into each counter a number of impulses equal to the maximum count of the counter for reading of each counter, said counter recording a count equal to the number of counts fed thereinto before and after reading of same.

25. A system according to claim 22 wherein said code generating means of each module includes a plurality of terminals and a common potential base line, said terminals being selectively connected to said base line to define a binary word unique to said each module.

26. A monitoring system for monitoring the operation of a machine of the kind intended to be operated in correspondence with a transaction involving money or valuable tokens comprising:

an electrical machine connection means connected to the machine and means for producing electrical operating signals at said connection means in correspondence with the operation of the machine;

an electrical recording module having an electrical recording means, and an electrical module connection means connected to said recording means, said module being detachably mountable in a machine with the machine connection means and the module connection means detachably interengageable so that electrical operating signals can be recorded by said recording means of the module;

an electrical reading device having an electrical reading means, and an electrical reading connection means connected to said reading means, the module connection means being detachably interengageable with the reading connection means so that said reading means can read said electrical operating signals recorded by the recording means of the module, and means for preserving said electrical operating signals, said reading device providing an interpretable output;

an electrical erasing device having an electrical erase means, and an electrical erase connection means connected to said erase means, the module connection means being detachably interengageable with the reading connection means in such a manner that said erase means can erase said electrical operating signals recorded by the recording means of the module;

and a protective system for preventing operative interconnection of said module with at least one of said machine and said reading and erasing devices which connection is out of a predetermined sequence.

27. A system according to claim 26, wherein each machine has a latch device thereon and further including a mechanical latching system on each module which is cooperable with said machine latch device for preventing reinsertion of a module into a machine after removal thereof before reading of said removed module.

28. A system according to claim 27, wherein said reading device and said erasing device further include latch devices which are cooperable with said machine latch device for preventing erasure of the module until it has been read.

29. A system according to claim 28, wherein said latch devices further prevent reinsertion of said module before it has been erased.

30. An electrical recording device for use in a monitoring system for monitoring the operation of a machine of the kind intended to be operated in correspondence with a transaction involving money or valuable tokens, the machine having a connection means, comprising a reading device; an erasing device; a module comprising a casing, electronic circuitry enclosed within said casing, said circuitry including electrical recording means having means for recording electrical operating signals determined by said machine operation and for retaining recorded signals even when the circuitry is not connected to a power source located externally of the module, and module input and output connection means for the circuitry located to be accessible from the exterior of the casing, said casing being detachably cooperative with said machine, with said reading device, and with said erasing device, said module connection means being detachably connected to connection means of the machine and said reading and erasing devices for receiving electrical operating signals from the machine, for feeding recorded signals to said reading device, and for receiving erasing signals for erasing said operating signals from said erasing device; a protective device on said module, and protective elements on said machine and reading and erasing devices which cooperate with said module protective device for preventing out-of-sequence operative interconnection of the module with at least one of said machine and reading and erasing devices.

31. A device according to claim 30, wherein said protective devices each comprises at least one latching member, said latching member having first and second positions, said latching member being arranged to block a first opening defined in the casing in said first position and to release said first opening in the second position, said first opening being sized to permit passage of said protective element therethrough only when the latching member is in the second position, and a second opening being defined in the casing for receiving a protective element therethrough for moving the latching member to said second position from said first position.

32. A device according to claim 31, further including a catch member associated with said latch member for holding said latch member releasably in each said position thereof.

33. A device according to claim 32, wherein the catch member covers said first opening when the latch member is in said second position and the catch member and the latch member are visible through said first opening and each have identifying indicia thereon.

34. A monitoring system for monitoring the operation of a plurality of machines of the kind intended to be operated in correspondence with a transaction involving money or valuable tokens comprising:

a plurality of machines each having an electrical machine connection means and means for producing electrical operating signals at said connection means in correspondence with operation of the machine, each said machine further including a code generating means connected to the machine connection means for producing at said machine connection means an electrical code signal unique to the respective machine;

a plurality of electrical recording modules, each module comprising electrical recording means and electrical module connection means, said recording means being connected to said module connection means for recording electrical signals applied to said module connection means, each said module further including a code generating means connected to the module connection means for producing at said module connection means an electrical code signal unique to the respective module;

said machine connection means of each machine being similar to the machine connection means of other machines, said module connection means of each module being similar to the module connection means of other modules and cooperable with said machine connection means so that any one module can be detachably mounted in any one machine with the connection means of the module and the machine detachably interengaged so that electrical operating and code signals produced by the machine can be recorded by said recording means of the module; and a common electrical reading device, said common electrical reading device being separate from said machines and from said modules, said reading device having an electrical reading means, and electrical reading connection means connected to said reading means, the module connection means of each of said modules being individually detachably interengageable with said reading connection means so that said reading means can read the module electrical code signal and also said electrical operating and machine code signals recorded by the recording means of the module, said reading device reading electrical signals stored in said recording modules without eradicating such signals from said recording modules.

35. A monitoring system for monitoring the operation of a plurality of machines of the kind intended to be operated in correspondence with a transaction involving money or valuable tokens comprising:

a plurality of machines each having an electrical machine connection means and means for producing electrical operating signals at said connection means in correspondence with operation of the machine, each said machine further including a code generating means connected to the machine connection means for producing at said machine connection means an electrical code signal unique to the respective machine;

a plurality of electrical recording modules, each module comprising electrical recording means and electrical module connection means, said recording means being connected to said module connection means for recording electrical signals applied to said module connection means;

said machine connection means of each machine being similar to the machine connection means of other machines, said module connection means of each module being similar to the module connection means of other modules and cooperable with said machine connection means so that any one module can be detachably mounted in any one machine with the connection means of the module and the machine detachably interengaged so that electrical operating and code signals produced by the machine can be recorded by said recording means of the module; and a common electrical reading device, said common electrical reading device being separate from said machines and from said modules, said reading device having an electrical reading means, and electrical reading connection means connected to said reading means, the module connection means of each of said modules being individually detachably interengageable with said reading connection means so that said reading means can read said electrical operating and code signals recorded by the recording means of the module, said reading device reading electrical signals stored in said recording modules without eradicating such signals from said recording modules to provide an interpretable output from the module;

an eraser means cooperable with said recording modules for erasing electrical signals from said recording modules after such signls have been read by said reading device; and means for preventing cooperation between a recording module and said eraser means prior to interengagement of such recording module with said reading device.

36. An electrical recording device for use in a monitoring system for monitoring the operation of a machine of the kind intended to be operated in correspondence with a transaction involving money or valuable tokens, comprising:

a casing;

electronic circuitry enclosed within said casing, said circuitry including first electrical recording means for recording electrical operating signals determined by machine operation, and second electrical recording means for recording an electrical code signal produced by and unique to the machine, said recording means having means for retaining recorded signals when the circuitry is not connected to a power source located externally of the module, said circuitry further including a code generating means for producing an electrical code signal unique to the module, and said circuitry further including input and output connection means, said connection means being located to be accessible from the exterior of the casing, said casing being detachably cooperative with said machine and a reading device, said connection means being detachably connectable to connection means on said machine and to connection means on said reading device for receiving electrical operating and code signals from said machine and for feeding said module code signal and also recorded said machine operating and code signals to said reading device.

37. A device according to claim 36, wherein the electrical recording means includes means for recording binary information.

38. A device according to claim 27, wherein the recording means comprises an electrical impulse counter.

39. A device according to claim 36 wherein the circuitry further includes a time recorder.

40. A device according to claim 39, wherein the time recorder comprises an impulse generator and an impulse counter connected to said impulse generator.

41. A device according to claim 36, wherein the circuitry further includes a plurality of electronic latches adapted to latch in different states on feed of appropriate inputs thereto for producing an input record.

42. A device according to claim 36, wherein the circuitry further includes means interconnecting a number of said terminals in a predetermined pattern for defining an electrical identifying code for the module.

43. A device according to claim 36, wherein the circuitry further includes a disabling circuit connected to one of said terminals and to the recording means for disabling said recording means when an actuating signal is present at said one terminal, and further including means for recording the duration of disablement of the recording means.

44. A device according to claim 43, wherein the timing means comprises an impulse generator and an impulse counter connected to said impulse generator.

45. A device according to claim 36, wherein the casing has a flat surface adapted to receive sheets, and further including attachment means for detachably holding such sheets on said surface.

46. A device according to claim 36, wherein the casing has a coded identification means thereon which includes raised characters.

* * * * *